US008944284B2

(12) United States Patent
Milan

(10) Patent No.: US 8,944,284 B2
(45) Date of Patent: Feb. 3, 2015

(54) PACKAGING LOCKING AND INDICATION SYSTEM

(75) Inventor: Guy Dimitri Milan, Woodbridge (GB)

(73) Assignee: Milan Innovation Ltd., Woodbridge, Suffolk (GB)

( * ) Notice: Subject to any disclaimer, the term of this patent is extended or adjusted under 35 U.S.C. 154(b) by 826 days.

(21) Appl. No.: 12/988,227

(22) PCT Filed: Apr. 15, 2009

(86) PCT No.: PCT/GB2009/050368

§ 371 (c)(1),
(2), (4) Date: Nov. 30, 2010

(87) PCT Pub. No.: WO2009/127867

PCT Pub. Date: Oct. 22, 2009

(65) Prior Publication Data

US 2011/0121023 A1 May 26, 2011

(30) Foreign Application Priority Data

Apr. 16, 2008 (GB) ..... 0806907.2
Aug. 1, 2008 (GB) ..... 0814057.6
Oct. 7, 2008 (GB) ..... 0818367.5

(51) Int. Cl.
*B67D 7/06* (2010.01)
*B67D 1/00* (2006.01)
(Continued)

(52) U.S. Cl.
CPC *G04F 1/02* (2013.01); *B65D 79/02* (2013.01); *G04F 1/00* (2013.01); *G04F 1/005* (2013.01); *B65D 2203/12* (2013.01)
USPC ..... 222/23; 222/65; 222/66; 222/639; 222/641; 340/309.16

(58) Field of Classification Search
USPC ..... 222/23, 638, 153.13, 153.14, 639, 640, 222/641, 642, 39, 643, 52, 63, 64, 65, 66, 222/67; 116/211, 223, 224, 227, 245.247, 116/335; 340/309.16, 586, 588, 589, 571, 340/693.5, 1.1, 5.1, 5.3, 309.4, 309.3, 620; 215/17, 18, 19, 26, 28, 263
See application file for complete search history.

(56) References Cited

U.S. PATENT DOCUMENTS 3,017,763 A 1/1962 Weil
3,018,056 A * 1/1962 Montgomery ..... 239/70
(Continued)

FOREIGN PATENT DOCUMENTS

DE 42 05 403 A1 8/1993
FR 2 887 646 A1 12/2006
(Continued)

OTHER PUBLICATIONS

International Search Report for parent application PCT/GB2009/050368, having a mailing date of Aug. 18, 2009.

*Primary Examiner* — Kevin P Shaver
*Assistant Examiner* — Stephanie E Williams
(74) *Attorney, Agent, or Firm* — Hayes Soloway P.C.

(57) ABSTRACT

A device for dispensing a material that has a limited period of utility, a novel device comprises a first part containing the material and a second part, wherein the first and second parts have mutual engagement means and can be disengaged to allow the material to be dispensed, wherein the device includes, located within the device, control mechanisms that can be activated to initiate a time-controlled period of use and that, at the end of that period, causes the first and second parts to be permanently engaged.

17 Claims, 11 Drawing Sheets

(51) Int. Cl.

| | |
|---|---|
| ***B67D 7/08*** | (2010.01) |
| ***G04C 1/12*** | (2006.01) |
| ***G08B 1/00*** | (2006.01) |
| ***G04F 1/02*** | (2006.01) |
| ***B65D 79/02*** | (2006.01) |
| ***G04F 1/00*** | (2006.01) |

(56) References Cited

U.S. PATENT DOCUMENTS

| | | | | | |
|---|---|---|---|---|---|
| 3,129,845 | A | * | 4/1964 | Musser | 222/41 |
| 4,298,143 | A | | 11/1981 | Peterson | |
| 4,361,408 | A | | 11/1982 | Wirtschafter | |
| 4,801,295 | A | | 1/1989 | Spencer | |
| 4,991,755 | A | * | 2/1991 | Grusmark | 222/638 |
| 5,076,197 | A | | 12/1991 | Darringer et al. | |
| 5,129,536 | A | | 7/1992 | Robinson | |
| 5,229,751 | A | * | 7/1993 | Chandler et al. | 340/618 |
| 5,457,665 | A | | 10/1995 | Reid | |
| 5,826,715 | A | | 10/1998 | Thompson | |
| 6,062,126 | A | | 5/2000 | Johnson et al. | |
| 6,202,540 | B1 | * | 3/2001 | Johnson et al. | 99/285 |
| 6,401,991 | B1 | | 6/2002 | Eannone | |
| 7,680,001 | B1 | | 3/2010 | D'Annunzio et al. | |
| 7,823,584 | B2 | * | 11/2010 | Geser et al. | 128/200.17 |
| 2002/0166871 | A1 | * | 11/2002 | Muderlak et al. | 222/23 |
| 2003/0090364 | A1 | | 5/2003 | Cardinale et al. | |
| 2004/0019453 | A1 | | 1/2004 | Blakley | |
| 2005/0252930 | A1 | * | 11/2005 | Contadini et al. | 222/52 |
| 2006/0163276 | A1 | * | 7/2006 | Wong et al. | 222/36 |
| 2010/0039252 | A1 | * | 2/2010 | Barkus | 340/521 |

FOREIGN PATENT DOCUMENTS

| | | | |
|---|---|---|---|
| GB | 1 370 989 | A | 10/1974 |
| GB | 2 199 016 | A | 6/1988 |
| GB | 2 358 178 | A | 7/2001 |
| GB | 2 378 941 | A | 2/2003 |
| GB | 2 459 317 | A | 10/2009 |
| WO | 02/056820 | A1 | 7/2002 |
| WO | 2005/020168 | A2 | 3/2005 |

* cited by examiner

PACKAGING LOCKING AND INDICATION SYSTEM

CROSS-REFERENCE TO RELATED APPLICATIONS

This application is the U.S. national stage application of International Application No. PCT/GB2009/050368, filed Apr. 15, 2009, which International application was published on Oct. 22, 2009, as International Publication No. WO2009/127867 A1 in the English language, which application is incorporated herein by reference. The International application claims priority of Great Britain Patent Application No. 0806907.2, filed Apr. 16, 2008, Great Britain Patent Application No. 0814057.6, filed Aug. 1, 2008, Great Britain Patent Application No. 0818367.5, filed Oct. 7, 2008, which applications are incorporated herein by reference.

FIELD OF THE INVENTION

The present invention relates to the packaging of non-durable products such as cosmetics, skin care products, sun care products, toiletries, foodstuffs, beverages and certain pharmaceutical products and other non-durable products, principally in containers with reusable closures, the quality and efficaciousness of which deteriorate with respect to time and or exposure to excessive temperature, humidity, light and air and or to the presence of microbes from the point of manufacture or from the first occasion at which the package is opened by the end user.

BACKGROUND OF THE INVENTION

The quality and efficaciousness and in some instances safety of non-durable products deteriorate over time, requiring the packaging within which they are contained to display a "Use By", "Best Before", "Expiration" or other date to indicate when the product will become unsuitable for use. Many products deteriorate at an accelerated rate once the packaging within which they are contained has been opened, the causes of which can be physico-chemical degradation due to time, exposure to excessive temperature, humidity, light and air and or microbial contamination. When the deterioration of a product after its opening could cause harm to the consumer, for example the degradation of the U.V. protection of a sun care product or the potential for microbial contamination of a mascara product, the period of time that the product will remain safe to use after opening or "Period after Opening" is often displayed on the product package. However, consumers frequently overlook or disregard the "Use By" or "Period after Opening" information provided, or fail to remember when a product package was first opened, with sometimes deleterious effects to product quality, health and safety.

With increasing consumer demand for non-durable products with improved quality, safety and lower preservative content, several improvements to the packaging for non-durable products have been suggested. GB2387941 describes a closure for preventing the opening of a bottle after an expiry date and consists of a conventional cap with an internal thread which mates with a threaded sleeve situated within a recess about the neck of a bottle. The sleeve is prevented from rotating about the neck of the bottle by lugs, manufactured from a bio-degradable plastics material, formed on the sleeve and located within indents formed on the neck of the bottle so that the torque required to remove or secure the cap to the bottle is transferred to the lugs. Once the plastic has degraded to a sufficient extent, the force required to remove the cap causes the lugs to shear, thus enabling the sleeve to rotate with the cap about the neck of the bottle, thereby preventing its removal. However, due to the imprecise nature of predicting when the bio-degradable material will degrade sufficiently for the lugs to shear, especially when exposed to changing conditions of temperature and humidity, it is difficult to ensure that the removal of the cap will be prevented within an acceptable time tolerance, thereby rendering the device impracticable for use in most product applications.

FR2887646 describes a time-indicating unit incorporated into the packaging for a fluid product-dispensing device, to provide a visual indication of elapsed time, to reduce the risk to a consumer caused by using a device containing expired product. The time-indicating unit is automatically activated by means of a push button upon first use of the product, but suffers the disadvantage that the user is relied upon to correctly interpret and act in accordance with the indication provided.

A number of time-temperature indicators have become available. Timestrip®, produced by Timestrip Plc (UK), for example, is a label-type device which relies on the migration of a tinted liquid through a micro-porous material at a rate dependant on temperature to provide an indication of time elapsed and is designed to monitor the shelf life of a wide range of opened or un-opened products to provide the consumer with a visual indication of when a product has reached the end of its useful life but suffers the disadvantage that the user is relied upon not only to activate and attach the device to the product package but also to correctly interpret and act in accordance with the indication provided. Fresh-Check® produced by the Temptime Corporation (USA), and Monitor-Mark™, produced by the 3M Corporation (USA), are label type time-temperature indicating devices designed to be affixed to or placed within the packaging for non-durable products and rely, respectively, upon the gradual darkening of a chemical indicator and the migration, at a rate dependant upon time and temperature, of a coloured indicator along a wicking material to provide the end user with a visual indication of when a product has reached the end of its useful life but, once again, suffer the disadvantage that the user is relied upon to correctly interpret and act in accordance with the indication provided.

To ensure product quality and efficacy and to safeguard the health and safety of consumers, a need therefore exists to prevent the use of non-durable products once the useful life of the product has been exceeded.

SUMMARY OF THE INVENTION

As will become apparent from the following description, and as expressed in the claims, there are at least 3 aspects of the present invention. In one aspect, this invention prevents disengagement of a two-part device after a predetermined time, so that dispensing of a material from one of the parts is prevented. In a second aspect, in consequence of a mechanism beyond the user's control, the device provides a display at the end of that period, to warn the user. In a third aspect, by similar means, tampering with the device is evident.

According to the present invention, a time or time-and-storage-conditions-dependant locking system for a product package incorporates, as desired, an indicator to provide the user with feedback as to the state of the locking system and to provide evidence that the package has been opened, the indicator aspect of the invention, whether time or time and storage conditions dependant or provided solely to indicate that a package has been opened, being applicable to the design of a product package independently of the product package locking system, comprising a first part containing a material to be dispensed or utilised, the material having a predetermined acceptable period of utility subject, or not, to its conditions of storage and or usage, and a second part which engages the first part and can be disengaged or displaced to allow the material to be dispensed or utilised through an aperture in the first part, and characterised by a means within the device composed of a locking means acting in unison with a measurement means, whereby, when the predetermined period of utility has elapsed, the first and second part cannot be disengaged or displaced and incorporating as desired a visual indication of the state of the means within the device.

A particular advantage of the present invention is that rather than relying on the end user to correctly identify, remember and act in accordance with the "Use By" or "Period after Opening" information displayed on a product package, or interpret, act in accordance with and in some cases activate an indicating device that may be attached to a product package, the locking system of the invention physically prevents the product from being dispensed from or utilised within the package after a predetermined period, subject, or not, to the storage conditions of the package, has elapsed.

The present invention utilises control means which can be activated, to initiate a time-controlled period of use, and which prevents disengagement after that period. Initiation can be at any suitable time, e.g. on first opening, and is not under the user's control.

A further advantage of the invention is that, when used to prevent the use of a product once its period after opening has expired, the indicator of the device may be so arranged as to provide, upon the first opening of the package, an indication that the period after opening has commenced and thus, with particular significance to the display and storage of products in a retail setting, provides evidence that the package has been opened, or "tamper evidence".

DESCRIPTION OF PREFERRED EMBODIMENTS

Figure 1:
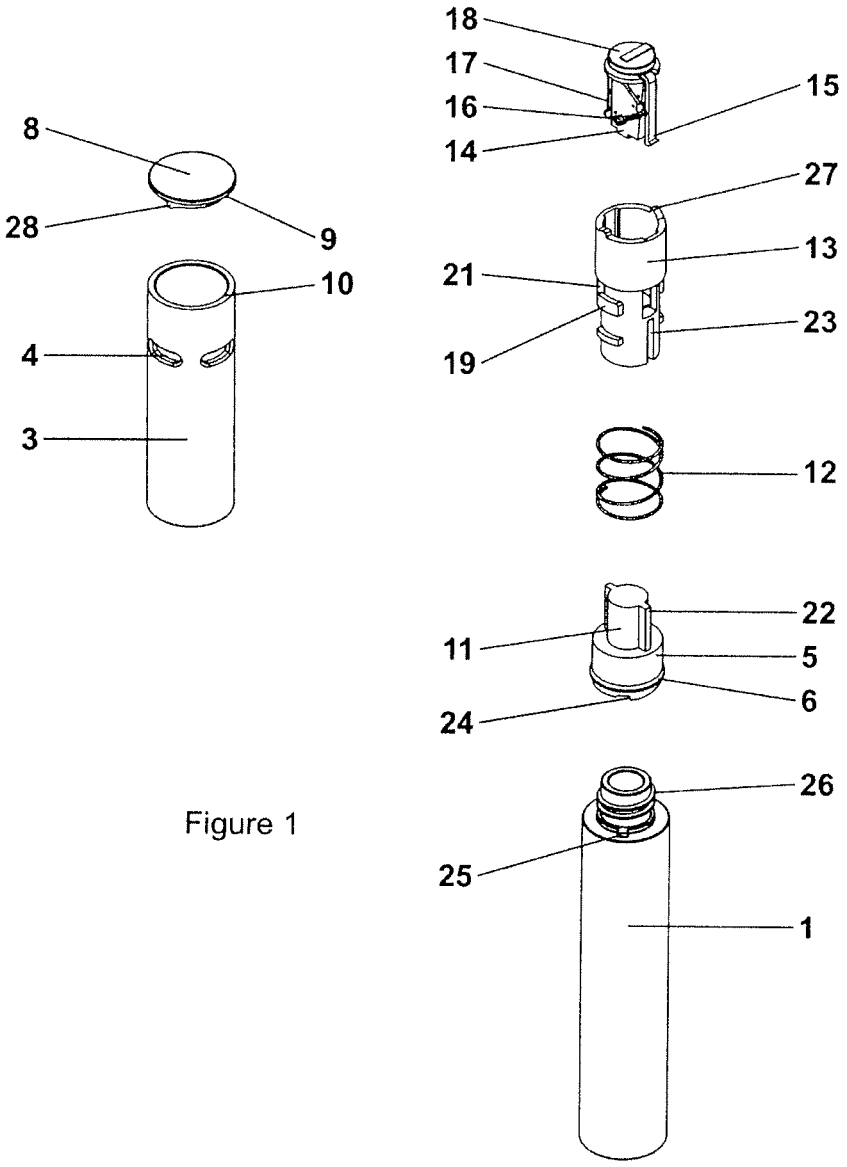
FIG. 1 shows, in perspective, the constituent parts of a product package consisting of a container with a screw cap incorporating an eLectronic-timer-and-latch-type locking system with visual indicator.

The first part of the invention may take any suitable form such as a container for a liquid or dry substance or other consumable product such as a water filter for example. Examples of materials that may be contained within the first part will be well known to those of ordinary skill in the art. They include cosmetics and colour cosmetics, e.g. mascara, eye pencils, eye liner, eye shadow, foundation, concealer, blusher, lip liner, lip gloss and lipstick, skin care products e.g. moisturising products, body oil, toners, make-up remover and depilatories, sun care products, e.g. sunscreen and self-tanning lotion, eye care products e.g. eye wash, eye drops and contact lens solution, pharmaceutical and medical products, e.g. vaccines, insulin, ear drops, ointments and cough and cold syrups and foodstuffs etc. The material may be in a single piece or discrete pieces. Depending on the nature of the material, means may be provided for its advancement through an aperture in the first part, whereby the user gains ready access to a further supply of the material or an applicator or other means may be provided to enable the material to be accessed and or applied or used by the user.

The second part of a device of the invention may take any suitable form such as a screw cap, hinged lid, valve or other reusable closure for a container. Preferably, the second part is provided with a means, such as a ratchet in the case of a screw cap or hinged lid, to enable the second part to be re-engaged or replaced should the first and second parts be disengaged or displaced when the predetermined period elapses.

The measurement means within the device may be of any nature suitable for the measurement of time or time and storage conditions, including temperature, humidity, light, air and or microbial contamination.

The measurement means within the device may be of an electrical-electronic nature such as a battery-operated electronic timer circuit so configured as to operate a shape-memory-alloy actuator, solenoid or other electrical-mechanical device at a predetermined time after the device has been activated, the electronic timer circuit including, or not, a monitoring capability for one or more storage conditions.

Alternatively, the measurement means within the device may be of a mechanical nature such as a spring-loaded piston and cylinder arrangement closed by a gas-permeable barrier, the spring so configured as to generate a positive pressure or partial vacuum within the cylinder, the gas pressure within the cylinder increasing or decreasing, depending on the configuration, with respect to the volume of gas transmitted by the gas-permeable barrier over time. The gas transmission rate of the gas-permeable barrier may be a function of its material or materials of construction, method of manufacture, thickness, area, temperature, humidity and the pressure differential across the barrier. Transmission results in either a relative movement of the piston with respect to the cylinder over time, or the displacement of the piston relative to the cylinder at a specific pressure differential, relative to temperature, humidity and external gas pressure. In an alternative spring-loaded piston and cylinder arrangement, the piston is not sealed to the bore of the cylinder and is so configured as to be capable of moving through a viscous fluid contained within the cylinder at a controlled rate, thereby resulting in a relative movement of the piston with respect to the cylinder over time, the viscosity of the fluid and hence the rate at which the piston is able to move through the viscous fluid being a function of temperature.

The locking means may be of any form suitable for preventing the disengagement or displacement of the first part relative to the second part, such as a movable element so configured as to prevent or enable, in concord with the state of the measurement means, the relative rotation of a first annular piece about a second annular piece, or a moveable element so configured as to prevent or enable, in concord with the state of the measurement means, the linear movement of a first piece with respect to a second piece.

Alternatively, the locking means may be so configured as to provide evidence that the package has been opened only.

The indicator of the device may be so arranged as to provide the user with feedback as to the state of the means before activation, upon activation and once the "use by" or "period after opening" has expired or may be so arranged as to provide, upon activation, a progressive indication of the time elapsed since activation or the time remaining before the "use by" or "period after opening" has expired.

Alternatively, the indicator of the device may be so arranged as to provide evidence that the package has been opened only, in concord with the suitable locking means.

Typically, a display of information in a device of the invention will be of different states, indicating one or more of: manufacture, packaging, initiation of the period of use, the period of utility, and the end of that period, i.e. that the device should no longer be used. For example, means within the second part may be provided, giving a display through a window or aperture in the outer wall of the second part.

Optionally, an audible or visual means acting in accordance with the state of the measurement means of the device may be included with or independently of the indicator of the device to signify to the user that the expiration of the "use by" or "period after opening" is approaching. Suitable audible means include a piezo sounder or other audible device acting in unison with the electronic timer and so configured as to play a recorded message or emit a tone or sequence of tones at regular intervals for a predetermined period before the "use by" or "period after opening" expires. Suitable visual means include a light-emitting diode or other light-emitting device acting in unison with the electronic timer and so configured as to flash at regular intervals for a predetermined period before the "use by" or "period after opening" expires.

Also optionally, an audible or visual means acting in accordance with the state of the measurement means of the device may be included with or independently of the indicator of the device to signify to the user, upon initiation, that the "period after opening" has begun. Suitable audible means include a piezo sounder or other audible device acting in unison with the electronic timer and so configured as to play a recorded message or emit a tone or sequence of tones. Suitable visual means include a light-emitting diode or other light-emitting device acting in unison with the electronic timer.

A first embodiment of the invention will now be described by way of example only with reference to FIGS. 1 to 8 of the accompanying drawings, in which:

FIG. 1 shows, in perspective, the constituent parts of a product package consisting of a container with a screw cap incorporating an electronic-timer-and-latch-type locking system with visual indicator.

Figure 2:
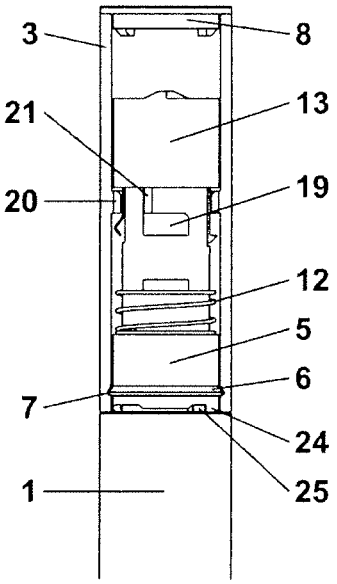
FIG. 2 shows, with the outer cap in section, the closed product container prior to the activation of the electronic-timer-and-latch-type locking system.

FIG. 2 shows, with the outer cap in section, the closed product container prior to the activation of the electronic-timer-and-latch-type locking system.

Figure 3:
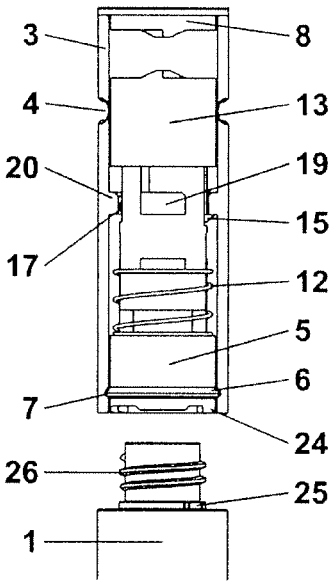
FIG. 3 shows, with the outer cap in section, the open product container with the electronic-timer-and-latch-type locking system activated.

FIG. 3 shows, with the outer cap in section, the open product container with the electronic-timer-and-latch-type locking system activated.

Figure 4:
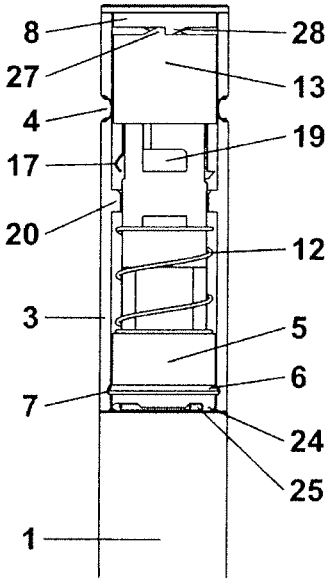
FIG. 4 shows, with the outer cap in section, the container and screw cap locked together by means of the electronic-timer-and-latch-type locking system.

FIG. 4 shows, with the outer cap in section, the container and screw cap locked together by means of the electronic-timer-and-latch-type locking system.

Figure 5:
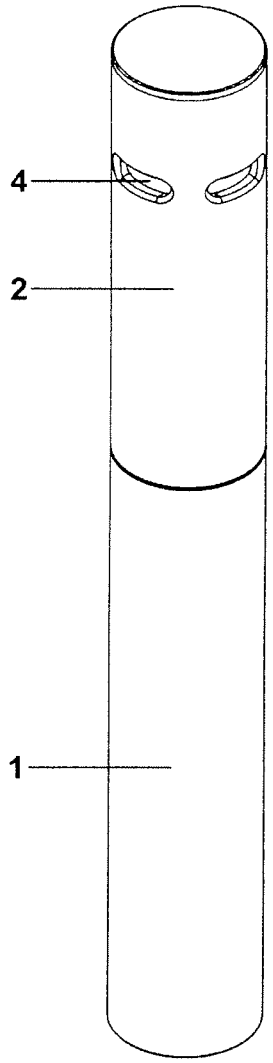
FIG. 5 shows the closed product container incorporating an electronic-timer-and-latch-type locking system with indication apertures.

FIG. 5 shows the closed product container incorporating an electronic-timer-and-latch-type locking system with indication apertures.

Figure 6:
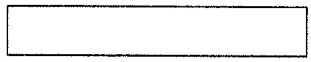
FIG. 6 shows the indication displayed in the indication apertures prior to the activation of the electronic-timer-and-latch-type locking system.

FIG. 6 shows the indication displayed in the indication apertures prior to the activation of the electronic-timer-and-latch-type locking system.

Figure 7:
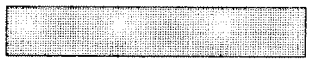
FIG. 7 shows the indication displayed in the indication apertures upon activation of the electronic-timer-and-latch-type locking system.

FIG. 7 shows the indication displayed in the indication apertures upon activation of the electronic-timer-and-latch-type locking system.

Figure 8:
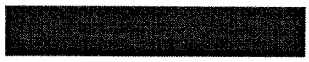
FIG. 8 shows the indication displayed in the indication apertures with the container and screw cap locked together by means of the electronic-timer-and-latch-type locking system.

FIG. 8 shows the indication displayed in the indication apertures with the container and screw cap locked together by means of the electronic-timer-and-latch-type locking system.

With reference to FIGS. 1 to 8, the product package incorporating an electronic-timer-and-latch-type locking system with visual indicator comprises a container 1 and a screw cap assembly 2 consisting of an outer cap 3, with indication apertures 4, locked together with, but free to rotate about, an inner cap 5 by means of a male rotatable annular snap fit 6 and a female rotatable annular snap fit 7. The outer cap 3 is closed at one end by an end cap 8, the positioning of which is determined by an index key 9 and index key slot 10. The inner cap 5 forms a piston 11 at one end, over which is placed a spring 12 and an actuator 13, the upper cylindrical outer face of which is printed with an indicator flag. Placed within the upper part of the actuator 13 is a timer/latch module 14 comprising a latch 15, a shape-memory-alloy actuator wire 16, a switch 17, a battery 18, and an electronic timer circuit with piezo sounder (not shown).

At assembly, the upper parts of the locking tabs 19 on the actuator 13 are held against the underside of the slotted shoulder 20 within the outer cap 3 by means of the spring 12. Clockwise movement of the outer cap 3 relative to the actuator 13 is prevented by the rotation limiters 21, enabling the screw cap assembly 2 to be screwed onto the container 1 without relative movement between the outer cap 3 and inner cap 5, the actuator 13 being prevented from rotating relative to the inner cap 5 by actuator guides 22 and guide slots 23 as shown in FIGS. 1 and 2 and the indication, as shown in FIG. 6, is provided in the indication apertures 4, as shown in FIG. 5.

Upper friction stops 24 on the inner cap 5 and lower friction stops 25 on the container 1 are so proportioned as to ensure that the torsional force required to rotate the outer cap 3 about the inner cap 5, with the spring 12 at its compressed length, is less than the torsional force required to unscrew the female thread (not shown) within the cap assembly 2 about the male thread 26 on the container 1, as shown in FIGS. 1 to 5.

When the outer cap 3 is rotated anticlockwise by fifty degrees about the inner cap 5, the slots in the slotted shoulder 20 line up with the locking tabs 19 on the actuator 13, the rotation limiters 21 preventing any further anticlockwise rotation of the outer cap 3 relative to the actuator 13 and the actuator 13, under the force of the spring 12, is moved upwards relative to the inner cap 5 until the switch 17 is closed by the slotted shoulder 20 on the outer cap 3 (thereby activating the electronic timer circuit) and the upper surface of the latch 15 makes contact with the underside of the slotted shoulder 20 on the outer cap 3 preventing any further vertical movement of the actuator 13 relative to the outer cap 3 and providing the indication as shown in FIG. 7 in the indication apertures 4 as shown in FIG. 5 and hence indicating to the user that the package has been opened and that the period after opening has commenced.

As the locking tabs 19 are now situated in the slots of the slotted shoulder 20, the actuator 13, and hence the inner cap 5 cannot be rotated relative to the outer cap 3, thereby enabling the screw cap assembly 2 to be disengaged and re-engaged with the container 1 in the manner of a common screw cap, as shown in FIGS. 1, 3 and 5.

Once the period after opening has commenced in accordance with the above, the electronic timer circuit begins to count down from a pre-determined time period.

From a pre-specified point in the count down, the piezo sounder periodically emits an audible signal to warn the user that the period after opening will soon expire.

When the count reaches zero the electronic timer circuit connects power to the shape-memory-alloy actuator wire 16 causing it to contract thereby retracting the latch 15. With the latch 15 retracted, the actuator 13, under force of the spring 12 is free to move upwards relative to the outer cap 3 until the locking tabs 19 and slotted shoulder 20 disengage, the switch 17 is opened, and the actuator 13 and the end cap 8 make contact, as shown in FIGS. 1 and 4, thereby irreversibly providing the indication as shown in FIG. 8 in the indication apertures 4 as shown in FIG. 5, and hence indicating to the user that the period after opening has elapsed.

Should the period after opening elapse whilst the screw cap assembly 2 and the container 1 are disengaged, lower ratchet teeth 27 on the actuator 13 and upper ratchet teeth 28 on the end cap 8 enable the screw cap assembly 2 to be screwed onto the container 1, a small compression of the spring 12 providing for the ratchet action as shown in FIGS. 1, 4 and 5.

Once the upper friction stops 24 and lower friction stops 25 have made contact and the screw cap assembly 2 cannot be further rotated clockwise relative to the container 1, any attempt to unscrew the screw cap assembly 2 from the container 1 will result in the outer cap 3 rotating about the inner cap 5 without any displacement of the inner cap 5 relative to the container 1 hence preventing the contents of the container 1 from being used as shown in FIGS. 1, 4 and 5.

Figure 9:
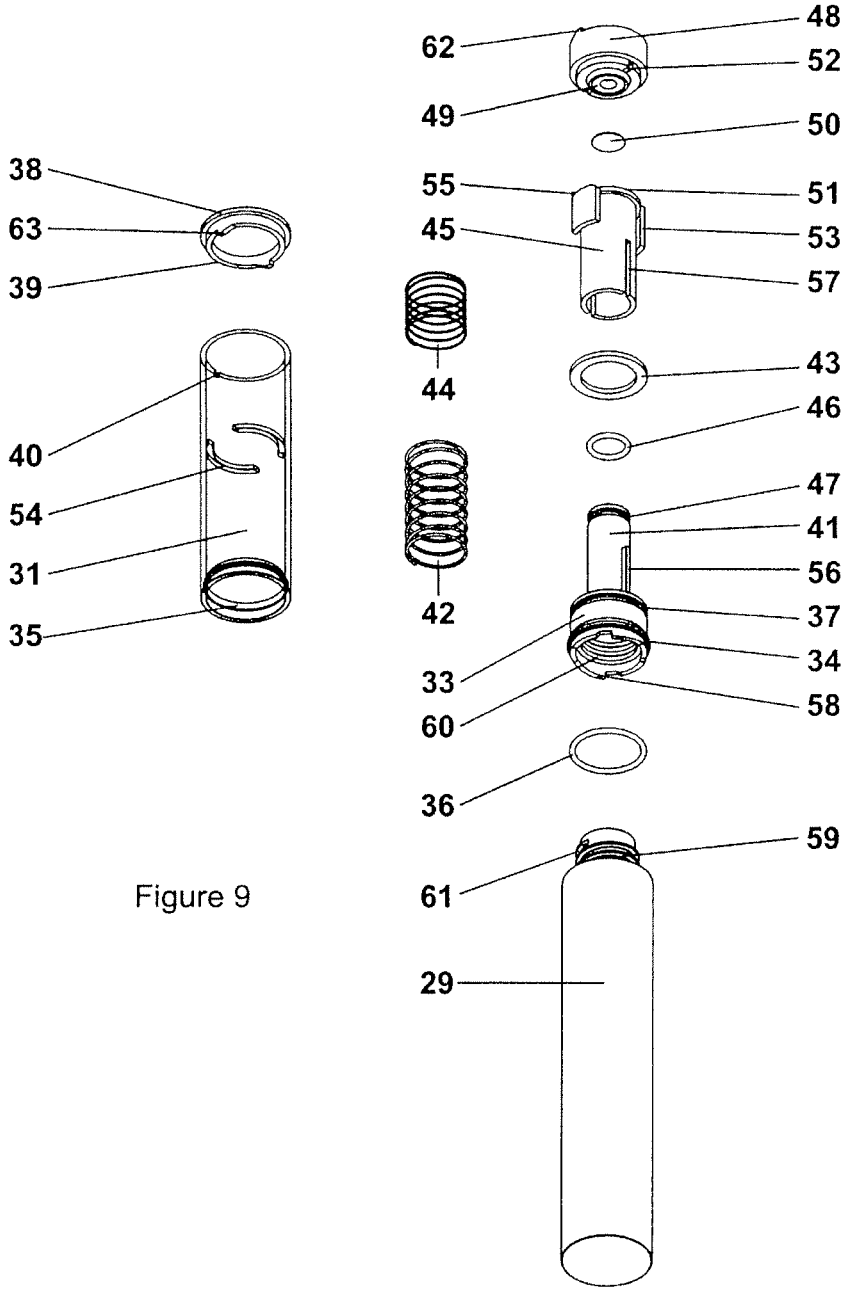
FIG. 9 shows, in perspective, the constituent parts of a product package consisting of a container with a screw cap incorporating a spring-loaded piston, cylinder and gas-permeable-barrier-type, time-temperature-dependant locking system with visual indicator.

A second embodiment of the invention will now be described by way of example only with reference to FIGS. 9 to 16 of the accompanying drawings, in which:

FIG. 9 shows, in perspective, the constituent parts of a product package consisting of a container with a screw cap incorporating a spring-loaded piston, cylinder and gas-permeable-barrier-type, time-temperature-dependant locking system with visual indicator.

Figure 10:
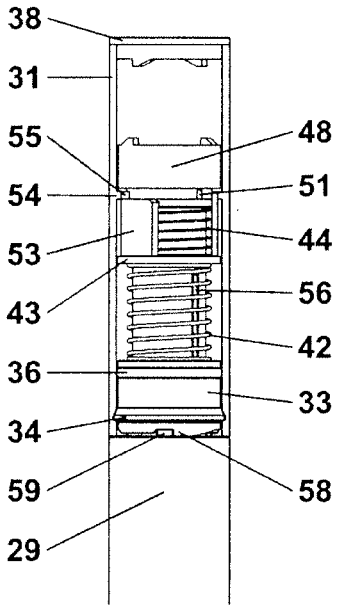
FIG. 10 shows, with the outer cap in section, the closed product container prior to the activation of the spring-loaded piston, cylinder and gas-permeable-barrier-type, time-temperature-dependant locking system.

FIG. 10 shows, with the outer cap in section, the closed product container prior to the activation of the spring-loaded piston, cylinder and gas-permeable-barrier-type, time-temperature-dependant locking system.

Figure 11:
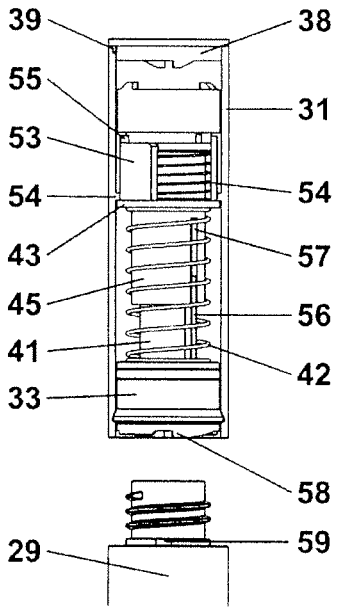
FIG. 11 shows, with the outer cap in section, the open product container with the spring-loaded piston, cylinder and gas-permeable-barrier-type, time-temperature-dependant locking system activated.

FIG. 11 shows, with the outer cap in section, the open product container with the spring-loaded piston, cylinder and gas-permeable-barrier-type, time-temperature-dependant locking system activated.

Figure 12:
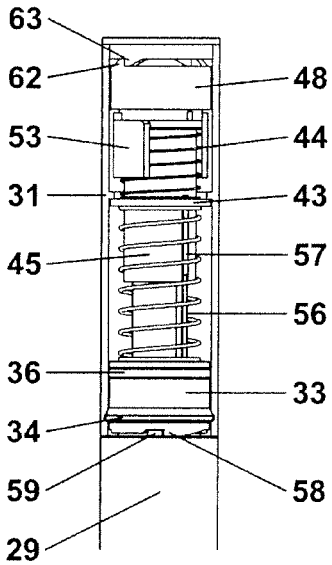
FIG. 12 shows, with the outer cap in section, the container and screw cap locked together by means of the spring-loaded piston, cylinder and gas-permeable-barrier-type, time-temperature-dependant locking system.

FIG. 12 shows, with the outer cap in section, the container and screw cap locked together by means of the spring-loaded piston, cylinder and gas-permeable-barrier-type, time-temperature-dependant locking system.

Figure 13:
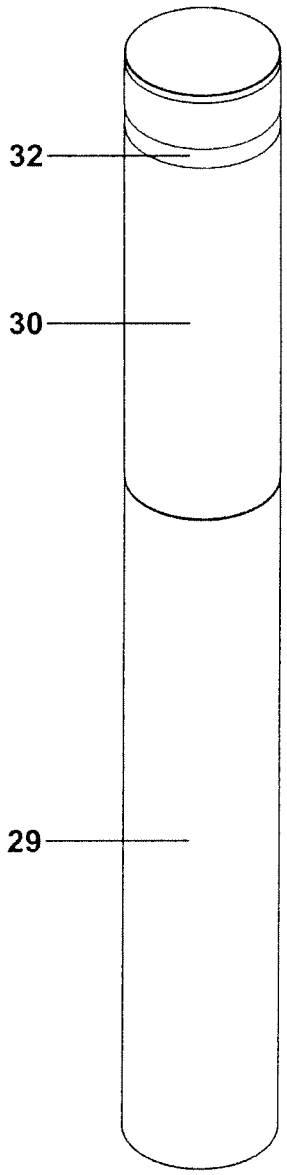
FIG. 13 shows the closed product container incorporating a spring-loaded piston, cylinder and gas-permeable-barrier-type, time-temperature-dependant locking system with indicator window.

FIG. 13 shows the closed product container incorporating a spring-loaded piston, cylinder and gas-permeable-barrier-type, time-temperature-dependant locking system with indicator window.

Figure 14:
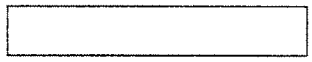
FIG. 14 shows the indication displayed in the indicator window prior to the activation of the spring-loaded piston, cylinder and gas-permeable-barrier-type, time-temperature-dependant locking system.

FIG. 14 shows the indication displayed in the indicator window prior to the activation of the spring-loaded piston, cylinder and gas-permeable-barrier-type, time-temperature-dependant locking system.

Figure 15:
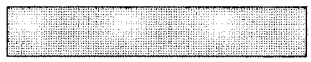
FIG. 15 shows the indication displayed in the indicator windowupon activation of the spring-loaded piston, cylinder and gas-permeable-barrier-type, time-temperature-dependant locking system.

FIG. 15 shows the indication displayed in the indicator window upon activation of the spring-loaded piston, cylinder and gas-permeable-barrier-type, time-temperature-dependant locking system.

Figure 16:
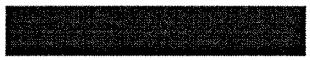
FIG. 16 shows the indication displayed in the indicator window with the container and screw cap locked together by means of the spring-loaded piston, cylinder and gas-permeable-barrier-type, time-temperature-dependant locking system.

FIG. 16 shows the indication displayed in the indicator window with the container and screw cap locked together by means of the spring-loaded piston, cylinder and gas-permeable-barrier-type, time-temperature-dependant locking system.

With reference to FIGS. 9 to 16, the product package incorporating a spring-loaded piston, cylinder and gas-permeable-barrier-type, time-temperature-dependant locking system with visual indicator comprises a container 29 and a screw cap assembly 30 consisting of a transparent outer cap 31, printed on its outer surfaces to provide an annular transparent indicator window 32, locked together with, but free to rotate about, an inner cap 33 by means of a male rotatable annular snap fit 34 and a female rotatable annular snap fit 35. The outer cap 31 is sealed at one end by a rotary seal 36 positioned within a rotary seal gland 37 on the inner cap 33 and at the other end by an end cap 38, the positioning of which is determined by an index key 39 and index key slot 40. The outer cap 31, inner cap 33, and end cap 38 are manufactured from a material with no, or a very low, permeability to air, thereby isolating the volume between the outer cap 31, inner cap 33 and end cap 38 from fluctuations in atmospheric pressure and humidity. The inner cap 33 forms a piston 41 at one end, over which is placed a power spring 42, a floating spring retainer 43, a control spring 44 and an actuator 45 manufactured from a material with no, or a very low, permeability to air, the bore of the actuator 45 being sealed to the piston 41 by means of a piston seal 46 positioned within a piston seal gland 47. Attached to the top of the actuator 45 in a gas tight manner is an indicator barrel 48, the outer cylindrical face of which is printed with an indicator flag, with a seat 49 having an aperture at its centre, to which is adhered a gas-permeable barrier 50 so that any flow of air around the edges of the gas-permeable barrier 50 is prevented. Index pins 51 and index pin slots 52 ensure that the actuator 45 and indicator barrel 48 are correctly aligned and cannot rotate with respect to one another.

At assembly, the upper parts of locking tabs 53 on the actuator 45 are held against the underside of slotted shoulders 54 within the outer cap 31 by means of the power spring 42 and the control spring 44. Clockwise movement of the outer cap 31 relative to the actuator 45 is prevented by rotation limiters 55, enabling the screw cap assembly 30 to be screwed onto the container 29 without relative movement between the outer cap 31 and inner cap 33. The actuator 45 is prevented from rotating relative to the inner cap 33 by actuator guides 56 and guide slots 57 as shown in FIGS. 9 and 10 and no indication, as shown in FIG. 14 is provided in the indication window 32 as shown in FIG. 13.

Upper friction stops 58 on the inner cap 33 and lower friction stops 59 on the container 29 are so proportioned as to ensure that the torsional force required to rotate the outer cap 31 about the inner cap 33, with the power spring 42 and control spring 44 at their compressed lengths is less than the torsional force required to unscrew the female thread 60 on the cap assembly 30 about the male thread 61 on the container 29 as shown in FIGS. 9 to 12.

When the outer cap 31 is rotated anticlockwise by fifty degrees about the inner cap 33, the slots in the slotted shoulder 54 line up with the locking tabs 53 on the actuator 45, the rotation limiters 55 preventing any further anticlockwise rotation of the outer cap 31 relative to the actuator 45 and the actuator 45, under the force of the power spring 42, is moved upwards relative to the inner cap 33 until the floating spring retainer 43 makes contact with the underside of the slotted shoulders 54 on the outer cap 31 thus causing, as a result of the relative displacement of the actuator 45 with respect to the piston 41, an increase in the pressure within the outer cap 31 and a pressure drop in the bore of the actuator 45 as shown in FIG. 11 and providing the indication as shown in FIG. 15 in the indication window 32 as shown in FIG. 13 and hence indicating to the user that the package has been opened and that the period after opening has commenced.

As the locking tabs 53 are now situated in the slots of the slotted shoulder 54, the actuator 45, and hence the inner cap 33 cannot be rotated relative to the outer cap 31, thereby enabling the screw cap assembly 30 to be disengaged and re-engaged with the container 29 in the manner of a common screw cap, as shown in FIGS. 9, 11 and 13.

Once the period after opening has commenced in accordance with the above, air from the volume within the outer cap 31 is slowly transmitted to the bore of the actuator 45, through the aperture in the indicator barrel 48 by means of the gas-permeable barrier 50 at a rate dependant upon temperature and the pressure differential between the bore of the actuator 45 and the volume within the outer cap 31 until such time as the force exerted by the control spring 44 between the floating spring retainer 43 and the actuator 45 is great enough to overcome the force exerted on the end of the actuator 45 due to the pressure differential between the bore of the actuator 45 and the volume within the outer cap 31 and the "break out" friction due to the piston seal 46, at which point the control spring 44 pushes the actuator 45 upwards until the locking tabs 53 and slotted shoulder 54 disengage and the indicator barrel 48 and the end cap 38 make contact, enabling, as a result of this movement, the pressure in the bore of the actuator 45 and pressure in the volume within the outer cap 31 to equalise by means of the guide slots/pressure equalisation ports 57 as shown in FIG. 12 and thereby irreversibly providing the indication as shown in FIG. 16 in the indication window 32 as shown in FIGS. 9 and 13 and hence indicating to the user that the period after opening has elapsed.

Should the period after opening elapse whilst the screw cap assembly 30 and the container 29 are disengaged, the lower ratchet teeth 62 on the indicator barrel 48 and the upper ratchet teeth 63 on the end cap 38 enable the screw cap assembly 30 to be screwed onto the container 29, a small compression of the control spring 44 providing for the ratchet action, as shown in FIGS. 9, 12 and 13.

Once the upper friction stops 58 and lower friction stops 59 have made contact and the screw cap assembly 30 cannot be further rotated clockwise relative to the container 29, any attempt to unscrew the screw cap assembly 30 from the container 29 will result in the outer cap 31 rotating about the inner cap 33 without any displacement of the inner cap 33 relative to the container 29, hence preventing the contents of the container 29 from being used, as shown in FIGS. 9, 12 and 13.

Figure 17:
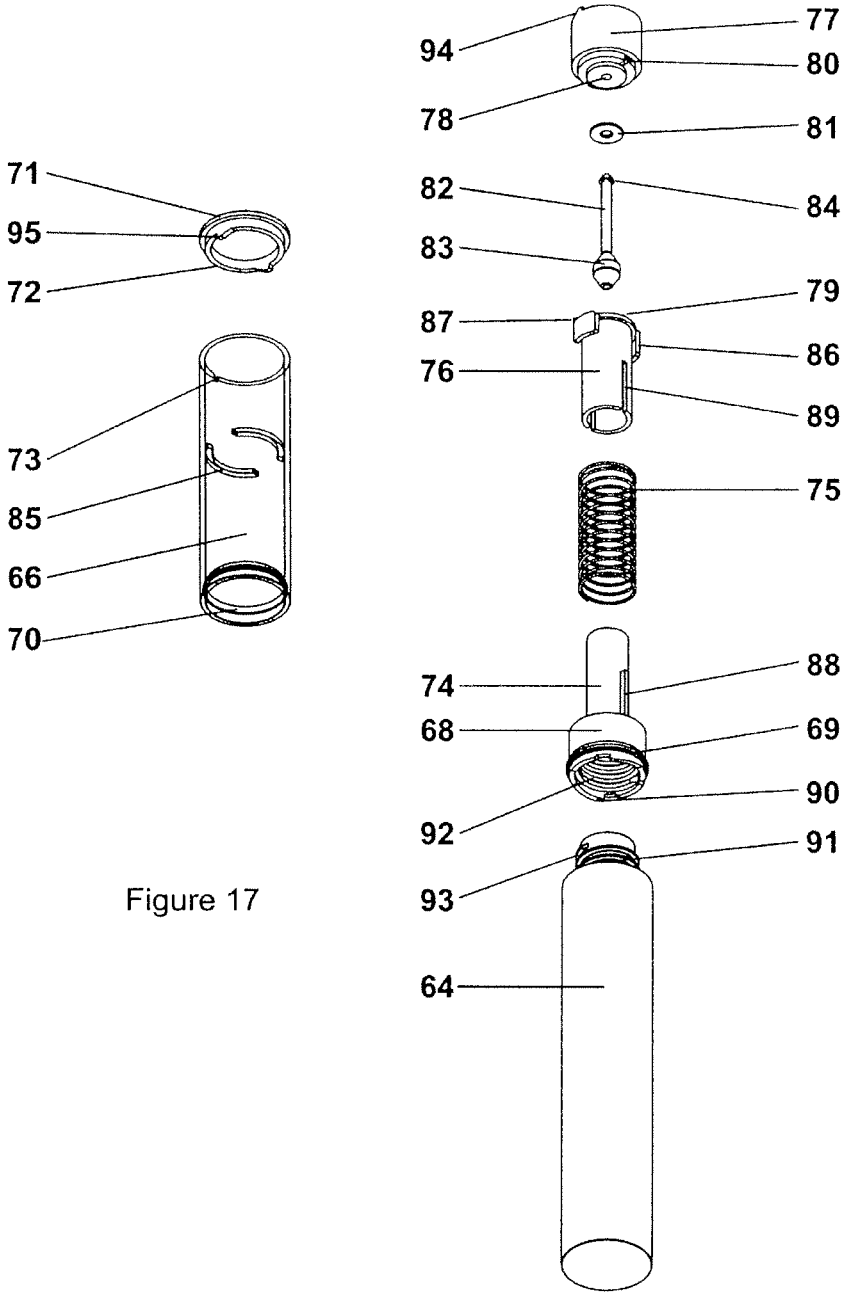
FIG. 17 shows, in perspective, the constituent parts of a product package consisting of a container with a screw cap incorporating a viscous fluid and non-sealed-piston-type, time-temperature-dependant locking system with visual indicator.

A third embodiment of the invention will now be described by way of example only with reference to FIGS. 17 to 24 of the accompanying drawings, in which:

FIG. 17 shows, in perspective, the constituent parts of a product package consisting of a container with a screw cap incorporating a viscous fluid and non-sealed-piston-type, time-temperature-dependant locking system with visual indicator.

Figure 18:
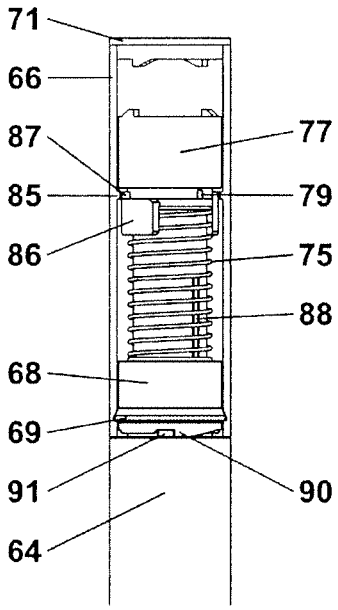
FIG. 18 shows, with the outer cap in section, the closed product container prior to the activation of the viscous fluid and non-sealed-piston-type, time-temperature-dependant locking system.

FIG. 18 shows, with the outer cap in section, the closed product container prior to the activation of the viscous fluid and non-sealed-piston-type, time-temperature-dependant locking system.

Figure 19:
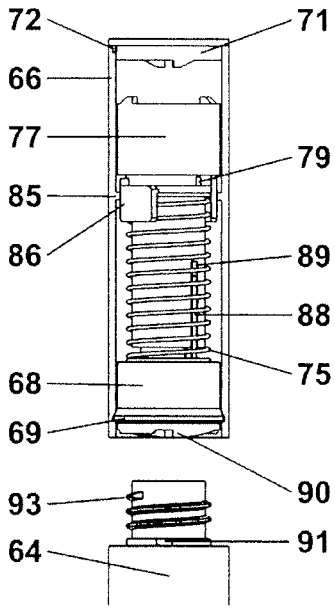
FIG. 19 shows, with the outer cap in section, the open product container with the viscous fluid and non-sealed-piston-type, time-temperature-dependant locking system activated.

FIG. 19 shows, with the outer cap in section, the open product container with the viscous fluid and non-sealed-piston-type, time-temperature-dependant locking system activated.

Figure 20:
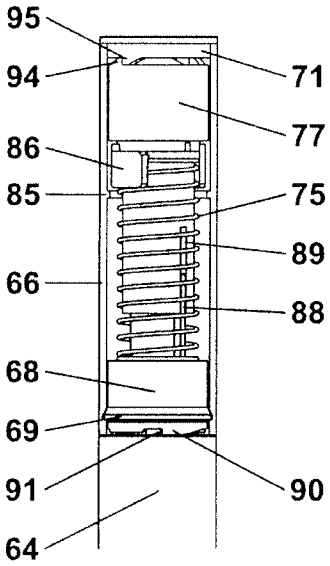
FIG. 20 shows, with the outer cap in section, the container and screw cap locked together by means of the viscous fluid and non-sealed-piston-type, time-temperature-dependant locking system.

FIG. 20 shows, with the outer cap in section, the container and screw cap locked together by means of the viscous fluid and non-sealed-piston-type, time-temperature-dependant locking system.

Figure 21:
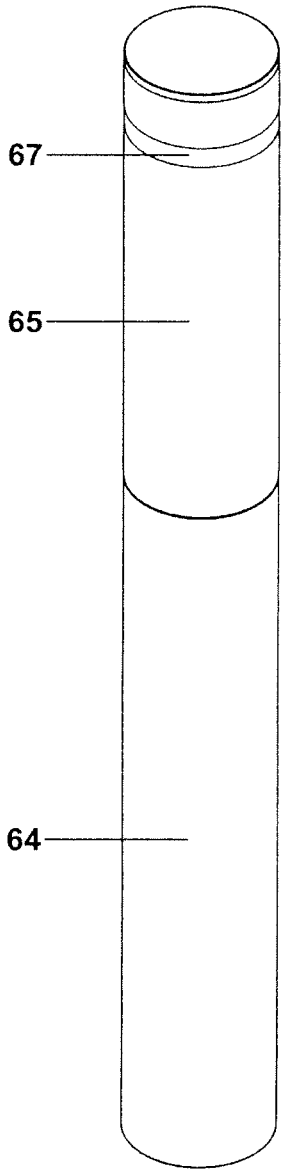
FIG. 21 shows the closed product container incorporating a viscous fluid and non-sealed-piston-type, time-temperature dependant locking system with indicator window.

FIG. 21 shows the closed product container incorporating a viscous fluid and non-sealed-piston-type, time-temperature dependant locking system with indicator window.

Figure 22:
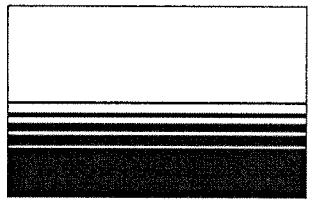
FIG. 22 shows a graduated indicator flag for a viscous fluid and non-sealed-piston-type, time-temperature-dependent locking system.

FIG. 22 shows a graduated indicator flag for a viscous fluid and non-sealed-piston-type, time-temperature-dependant locking system.

Figure 23:
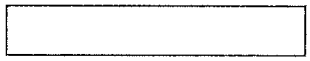
FIG. 23 shows the indication displayed in the indicator window upon activation of the viscous fluid and non-sealed-piston-type, time-temperature-dependent locking system.

FIG. 23 shows the indication displayed in the indicator window upon activation of the viscous fluid and non-sealed-piston-type, time-temperature-dependant locking system.

Figure 24:
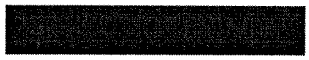
FIG. 24 shows the indication displayed in the indicator window with the container and crew cap locked together by means of the viscous fluid and non-sealed-piston-type, time-temperature-dependant locking system.

FIG. 24 shows the indication displayed in the indicator window with the container and screw cap locked together by means of the viscous fluid and non-sealed-piston-type, time-temperature-dependant locking system.

With reference to FIGS. 17 to 22, the product package incorporating a viscous fluid and non-sealed-piston-type, time-temperature-dependant locking system with visual indicator comprises a container 64 and a screw cap assembly 65 consisting of a transparent outer cap 66, printed on its outer surfaces to provide an annular transparent indicator window 67, locked together with, but free to rotate about, an inner cap 68 by means of a male rotatable annular snap fit 69 and a female rotatable annular snap fit 70. The outer cap 66 is closed at one end by an end cap 71, the positioning of which is determined by an index key 72 and index key slot 73.

The inner cap 68 forms at one end a cylinder 74 over which is placed a spring 75 and an actuator 76 with an aperture at its centre equal in diameter to the diameter of the cylinder 74. Attached to the top of the actuator 76 is an indicator barrel 77, with an aperture 78 at its centre, the outer cylindrical face of which is printed with a graduated indicator flag as shown in FIG. 22, index pins 79 and index pin slots 80 ensuring that the actuator 76 and indicator barrel 77 are correctly aligned and cannot rotate with respect to one another. Fixed to the mouth of the cylinder 74 is a cylinder cap 81 to prevent the escape of a viscous fluid (not shown) contained within the cylinder 74. Placed within the cylinder 74, and hence within the viscous fluid, and passing through an aperture in the cylinder cap 81 and the aperture 78 in the indicator barrel 77, is a piston rod 82 with a piston bulb 83 at one end and a piston snap fit 84 at the other end. The piston rod 82 is proportioned so that when the piston bulb 83 is at its lowest point within the cylinder 74, the shoulder of the piston snap fit 84 is positioned at a distance greater than the thickness of the slotted shoulder 85 within the outer cap 66 above the upper, inner surface of the indicator barrel 77.

At assembly, the upper parts of the locking tabs 86 on the actuator 76 are held against the underside of the slotted shoulder 85 within the outer cap 66 by means of the spring 75. Clockwise movement of the outer cap 66 relative to the actuator 76 is prevented by the rotation limiters 87, enabling the screw cap assembly 65 to be screwed onto the container 64 without relative movement between the outer cap 66 and inner cap 68, the actuator 76 being prevented from rotating relative to the inner cap 68 by actuator guides 88 and guide slots 89 as shown in FIGS. 17 and 18 and no indication, as shown in FIG. 23, is provided in the indication window 67, as shown in FIG. 21.

Upper friction stops 90 on the inner cap 68 and lower friction stops 91 on the container 64 are so proportioned as to ensure that the torsional force required to rotate the outer cap 66 about the inner cap 68, with the spring 75 at its compressed length, is less than the torsional force required to unscrew the female thread 92 on the cap assembly 65 about the male thread 93 on the container 64, as shown in FIGS. 17 to 21.

When the outer cap 66 is rotated anticlockwise by fifty degrees about the inner cap 68, the slots in the slotted shoulder 85 line up with the locking tabs 86 on the actuator 76, the rotation limiters 87 preventing any further anticlockwise rotation of the outer cap 66 relative to the actuator 76, and the actuator 76 and hence the indicator barrel 77, under the force of the spring 75, is moved upwards relative to the inner cap 68 until the shoulder of the piston snap fit 84 on the piston rod 82 makes contact with upper, inner surface of the indicator barrel 77 thus providing, as a result of the relative displacement of the actuator 76 with respect to the inner cap 68, the indication, as shown in FIG. 23 in the indication window 67 as shown in FIG. 21, and hence indicating to the user that the package has been opened and that the period after opening has commenced.

As the locking tabs 86 are now situated in the slots of the slotted shoulder 85, the actuator 76, and hence the inner cap 68 cannot be rotated relative to the outer cap 66, thereby enabling the screw cap assembly 65 to be disengaged and re-engaged with the container 64 in the manner of a common screw cap, as shown in FIGS. 17, 19 and 21.

Once the period after opening has commenced in accordance with the above, the force exerted by the spring 75, through the actuator 76 and indicator barrel 77, on the shoulder of the piston snap fit 84 causes the piston bulb 83 to slowly move through the viscous fluid contained within the cylinder 74 at a rate dependant upon the viscosity of the fluid, the viscosity of the fluid being a function of temperature, until the locking tabs 86 and slotted shoulder 85 disengage and the indicator barrel 77 and the end cap 71 make contact, as shown in FIGS. 17 and 20, thereby irreversibly providing the indication as shown in FIG. 24 in the indication window 67 as shown in FIG. 21, and hence indicating to the user that the period after opening has elapsed.

Should the period after opening elapse whilst the screw cap assembly 65 and the container 64 are disengaged, lower ratchet teeth 94 on the indicator barrel 77 and upper ratchet teeth 95 on the end cap 71 enable the screw cap assembly 65 to be screwed onto the container 64, a small compression of the spring 74 providing for the ratchet action as shown in FIGS. 17, 20 and 21.

Once the upper friction stops 90 and lower friction stops 91 have made contact and the screw cap assembly 65 cannot be further rotated clockwise relative to the container 64, any attempt to unscrew the screw cap assembly 65 from the container 64 will result in the outer cap 66 rotating about the inner cap 68 without any displacement of the inner cap 68 relative to the container 64 hence preventing the contents of the container 64 from being used as shown in FIGS. 17, 20 and 21.

Figure 25:
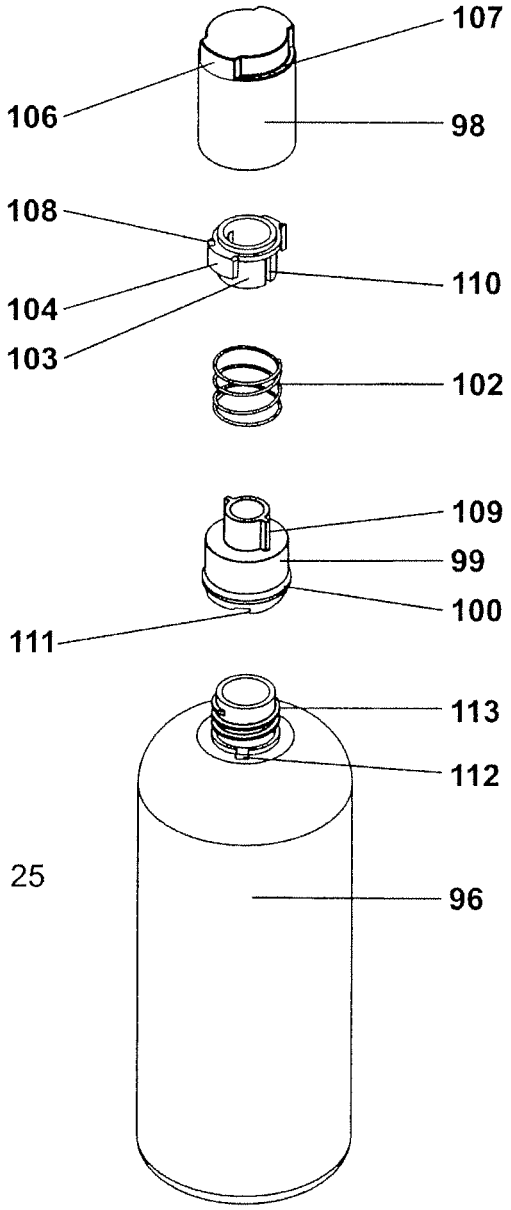
FIG. 25 shows in perspective, the constituent parts of a product package consisting of a container with a screw cap incorporating a tamper-evidence-only-type locking system.

A fourth embodiment of the invention will now be described by way of example only with reference to FIGS. 25 to 29 of the accompanying drawings, in which:

FIG. 25 shows in perspective, the constituent parts of a product package consisting of a container with a screw cap incorporating a tamper-evidence-only-type locking system.

Figure 26:
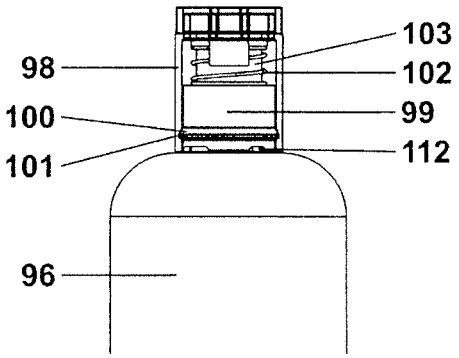
FIG. 26 shows with the outer cap in section, the closed product container prior to the activation of the tamper-evidence-only-type locking system.

FIG. 26 shows with the outer cap in section, the closed product container prior to the activation of the tamper-evidence-only-type locking system.

Figure 27:
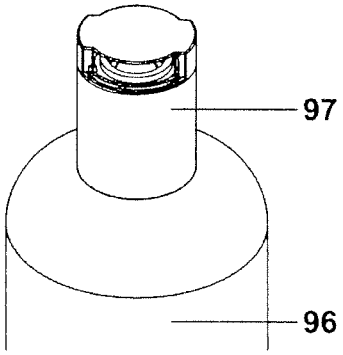
FIG. 27 shows, in perspective, the closed product container prior to the activation of the tamper-evidence-only-type locking system.

FIG. 27 shows, in perspective, the closed product container prior to the activation of the tamper-evidence-only-type locking system.

Figure 28:
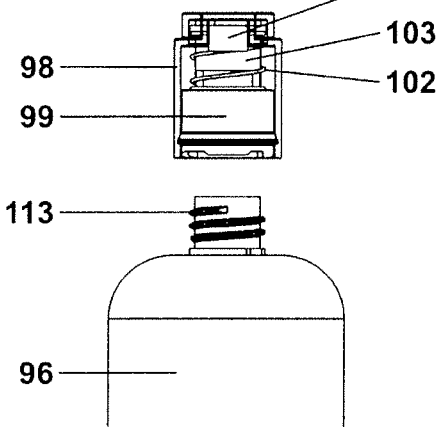
FIG. 28 shows, with the outer cap in section, the open product container after activation of the tamper-evidence-only-type locking system.

FIG. 28 shows, with the outer cap in section, the open product container after activation of the tamper-evidence-only-type locking system.

Figure 29:
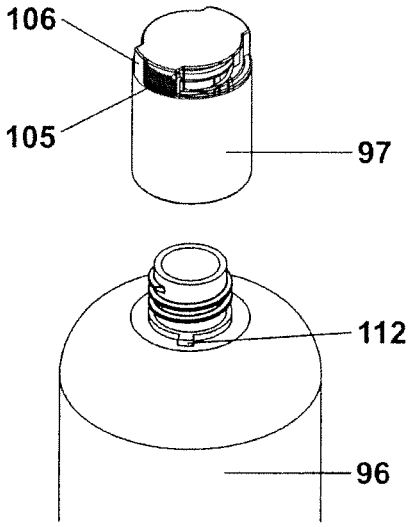
FIG. 29 shows in perspective, the open product container after activation of the tamper-evidence-only-type locking system.

FIG. 29 shows in perspective, the open product container after activation of the tamper-evidence-only-type locking system.

With reference to the accompanying drawings, the package incorporating a tamper-evidence-only-type locking system comprises a container 96 and a screw cap assembly 97 consisting of an outer cap 98 locked together with, but free to rotate about, an inner cap 99 by means of a male rotatable annular snap fit 100 and female rotatable annular snap fit 101 and containing a spring 102, and an actuator 103 with locking tabs 104 the outer faces of which are printed with an indicator flag 105. The outer cap 98 is manufactured from a transparent material and printed on its outer surfaces to provide a transparent indicator window 106, as shown in FIGS. 25 to 29.

At assembly, the upper parts of the locking tabs 104 on the actuator 103 are held against slotted shoulder 107 within the outer cap 98 by means of the spring 102. Clockwise movement of the outer cap 98 relative to the actuator 103 is prevented by rotation limiters 108, enabling the screw cap assembly 97 to be screwed onto the container 96 without relative movement between the outer cap 98 and inner cap 99, actuator 103 and spring 102, the actuator 103 being prevented from rotating relative to the inner cap 99 by actuator guides 109 and guide slots 110, as shown in FIGS. 25, 26 and 27.

Upper friction stops 111 on the inner cap 99 and lower friction stops 112 on the container 96 are so proportioned as to ensure that the torsional force required to rotate the outer cap 98 about the inner cap 99 is less than the torsional force required to unscrew the inner cap 99 about the male thread 113 on the container 96, as shown in FIGS. 25 and 26.

When the outer cap 98 is rotated anticlockwise by fifty degrees about the inner cap 99, the slots in the slotted shoulder 107 line up with the locking tabs 104 on the actuator 103, the rotation limiters 108 preventing any further anticlockwise rotation of the outer cap 98 relative to the actuator 103. The actuator 103, under the force of the spring 102, is then moved into contact with the upper part of the outer cap 98 thus irreversibly locking the outer cap 98 to the inner cap 99 and enabling the indicator flags 105 to be viewed through the indicator windows 106 and providing a permanent indication to the user that the package has been opened. The screw cap assembly 97 may now be disengaged and re-engaged with the container 96 in the manner of a common screw cap, as shown in FIGS. 25, 28 and 29.

The retraction of the latch may be achieved by the contraction of a shape-memory-alloy actuator wire as shown in the first embodiment of the invention or by any other suitable thermal shape-memory-alloy effects.

The seal between the cylinder of the actuator and the piston of the inner cap may be achieved by means of an 'O' ring as shown in the second embodiment of the invention or by any other suitable means such as a 'U' seal, 'X' seal, or a composite seal comprising, for example, a polymer jacket energised by a metallic spring, a polymer jacket energised by an 'O' ring or a polymer jacket energised by a spring element or elements formed on the end of the piston, by means of a single or multiple shot injection-moulding process, as an integral part of the inner cap.

The invention claimed is:

1. A device for dispensing a material that has a limited period of utility, the device comprising a first part containing the material and a second part, wherein the first and second parts are mechanically engaged and can be disengaged to allow the material to be dispensed, wherein the device includes, located within the device, control means that can be activated to initiate a time-controlled period of use and that, at the end of that period, causes the first and second parts to be permanently engaged, and wherein the time-controlled period has a duration that is determined by an electronically controlled timer.

2. A device according to claim 1, wherein the second part includes external and internal members and means for locking or biasing these members against relative movement such that manipulation of the external member allows engagement of the first and second parts of the device, wherein relative movement of the internal and external members when the first and second parts are engaged initiates a change of a property within the second part, wherein the second part further includes means for allowing relative movement of the internal and external members when the property has changed to a predetermined extent.

3. A device according to claim 2, wherein the internal and external members of the second part are relatively rotatable about a common axis.

4. A device according to claim 2, wherein the internal and external members of the second parts are capable of linear movement relative to each other.

5. A device according to claim 2, wherein the means for allowing relative movement of the internal and external members when the property has changed to a predetermined extent is electromechanical in nature.

6. A device according to claim 2, wherein the means for allowing relative movement of the internal and external members when the property has changed to a predetermined extent is a shape-memory-alloy actuator.

7. A device according to claim 1, which comprises a visible display, under the control of means within the device, that is activated in response to one or more of manufacture, packaging, first use and end of use.

8. A device according to claim 7, wherein the display indicates a change of status, whether discrete or gradual.

9. A device according to claim 1, wherein the period is initiated on first disengaging the first and second parts.

10. A device according to claim 1, which comprises means for transmitting a signal to warn a user when the end of the period is approaching.

11. A device according to claim 1, wherein the first and second parts are engaged via screw threads.

12. A device according to claim 1, wherein the second part is provided with a means to enable the second part to be re-engaged or replaced should the first and second part be disengaged or displaced when the predetermined period elapses.

13. A device according to claim 2, wherein the means for allowing relative movement of the internal and external members when the property has changed to a predetermined extent is a solenoid.

14. A device according to claim 7, wherein the visible display is activated in response to the initiation of a change in property.

15. A device according to claim 7, wherein the display is at least one of a graphic and color.

16. A device according to claim 10, wherein the signal is visible.

17. A device according to claim 1, wherein the material is at least one of a cosmetic, cosmeceutical and make-up composition.

* * * * *